United States Patent [19]

Hanna

[11] Patent Number: 5,000,815

[45] Date of Patent: Mar. 19, 1991

[54] APPARATUS FOR APPLYING A CORRECTION STICKER TO A DOCUMENT

[75] Inventor: Peter D. Hanna, Waterloo, Canada

[73] Assignee: NCR Corporation, Dayton, Ohio

[21] Appl. No.: 286,395

[22] Filed: Dec. 19, 1988

[51] Int. Cl.[5] ..... B44C 1/00

[52] U.S. Cl. ..... 156/542; 156/579; 156/DIG. 33; 156/DIG. 48

[58] Field of Search ..... 156/249, 541, 542, 579, 156/DIG. 33, DIG, 39, DIG, 48, DIG, 50, 530; 221/69, 73

[56] References Cited

U.S. PATENT DOCUMENTS

| | | | |
|---|---|---|---|
| 26,543 | 12/1859 | Wright | 156/530 |
| 3,271,227 | 9/1966 | Jaeckel | 156/541 |
| 3,690,996 | 9/1972 | Rünzi | 156/542 |

*Primary Examiner*—Michael W. Ball
*Assistant Examiner*—Chester T. Barry
*Attorney, Agent, or Firm*—Wilbert Hawk, Jr.; Albert L. Sessler, Jr.; Elmer Wargo

[57] ABSTRACT

A method and apparatus for applying a correction sticker to a document to cover incorrect data entered on a field on the document. Correction stickers on a carrier strip are fed to an application station where a document whose field to be covered is located. An ejector plate and a pressure plate located at the application station are used to partially separate a correction sticker from the carrier and to position the leading edge of the correction sticker in an application position with regard to the field on the document to be covered. An operating lever having a roller on one end thereof is used to move the leading edge of the correction sticker into adherence with the document. The roller is then held in contact with the correction sticker as the document is pulled out of the application station to press the remaining portion of the correction sticker into adherence with the field on the document.

4 Claims, 6 Drawing Sheets

APPARATUS FOR APPLYING A CORRECTION STICKER TO A DOCUMENT

BACKGROUND OF THE INVENTION (1) Field of the Invention

This invention relates to a method and apparatus for applying a correction sticker to a document so as to cover incorrectly entered data on the document and to present a clear area on the correction sticker, itself, to receive correct data in a subsequent operation, like a printing operation, for example.

(2) Description of the Related Art

In the processing of financial documents, like checks, in a banking environment, a typical operation includes the entering of the monetary amount of the check into a processing machine which later prints this amount on the check. In the U.S.A., for example, the monetary amount is printed on the check in MICR (magnetic) ink in a particular style or font which is referred to as E13B. The monetary amount is printed just below the signature line on the check.

An operator who enters the monetary amount of the check into the processing machine will, at times, make mistakes in entering the monetary amount. One general method for correcting the monetary amount on a check in Europe, for example, is to use a liquid solvent which removes the MICR ink associated with the incorrect entry, permitting the correct monetary amount to be printed on the document in a subsequent operation. This method of correction does not appear to remove all of the magnetic ink associated with the incorrect entry, and the use of the liquid solvent is considered a health hazard in some countries.

A primary method of correcting an incorrectly entered monetary amount on a check in the United States, for example, is to use a correction sticker to cover the incorrect data. The correction sticker is large enough to cover the amount field where the monetary amount is located so as to present a clean area to receive the correct monetary amount in a subsequent printing operation. The correction stickers have pressure sensitive adhesive on one side thereof, and they are supported in spaced, parallel relationship on a long strip or carrier (formed into a roll) in a currently available product. The carrier is coated with a silicon release agent to enable the correction stickers to be easily removed from the carrier.

The most common method of applying a correction sticker to a document is to apply it manually. In this regard, an operator "peels" one of the correction stickers from the carrier and manually positions it over the incorrect data. Thereafter, the operator presses the correction sticker onto the document, causing the correction sticker to stick to the document via the associated pressure sensitive adhesive.

One of the problems associated with the manual method of applying the correction stickers is that they may be inaccurately applied, causing reader-sorter jams and rejects. Another problem is that the manual method is time-consuming.

Another method of applying correction stickers is to apply them automatically. In this regard, there is at least one such machine currently in use. One of the problems associated with the machine is that it requires the correction stickers to be mounted on a special, perforated carrier strip to enable the carrier strip to be "pin fed" to an application station in the machine. Another problem with the machine is that it occupies a large area or has a large "foot print". The machine is also expensive.

SUMMARY OF THE INVENTION

In contrast with the problems previously mentioned, the present invention provides a simple method and apparatus for accurately positioning and securing a correction sticker over the incorrect monetary amount on a document, like a check.

In one aspect of this invention, there is provided an apparatus for applying a correction sticker to cover a field on a document, comprising:

a frame;

an application station located on said frame;

locating means for locating a document so that the field to be covered on the document is positioned in operative relationship with said application station;

positioning means for positioning the leading edge of the correction sticker at an application position at said application station; said correction sticker having a pressure sensitive adhesive thereon;

said positioning means including an operating lever being moveable between first and second positions relative to said application station, with said operating lever having an applying member thereon;

said operating lever when moved incrementally towards said first position being effective to incrementally move the leading edge of the correction sticker towards said application position, and said operating lever when moved to said second position enabling said applying member to move the leading edge of the correction sticker into adherence with said document and also to enable said applying member to press the remaining portion of said correction sticker into adherence with said document to cover said field as said operating lever is retained in the second position and the document is pulled out of the application station.

In another aspect of the invention, there is provided a method for applying a correction sticker to cover a field on a document comprising the steps of:

(a) positioning a document at an application station so that the field of the document to be covered is positioned in operative relationship with the application station;

(b) moving a carrier with a plurality of correction stickers thereon towards said application station;

(c) partially separating one of the correction stickers from the carrier so that the leading edge of the correction sticker at the application station is positioned at an application position relative to the field of the document at the application station, with the correction sticker having pressure sensitive adhesive thereon;

(d) moving the leading edge of the correction sticker into adherence with the document; and (e) pressing the remaining portion of the correction sticker into engagement with the field on the document.

These advantages and others will be more readily understood in connection with the following description, claims, and drawing.

DESCRIPTION OF THE PREFERRED EMBODIMENT

Figure 1:
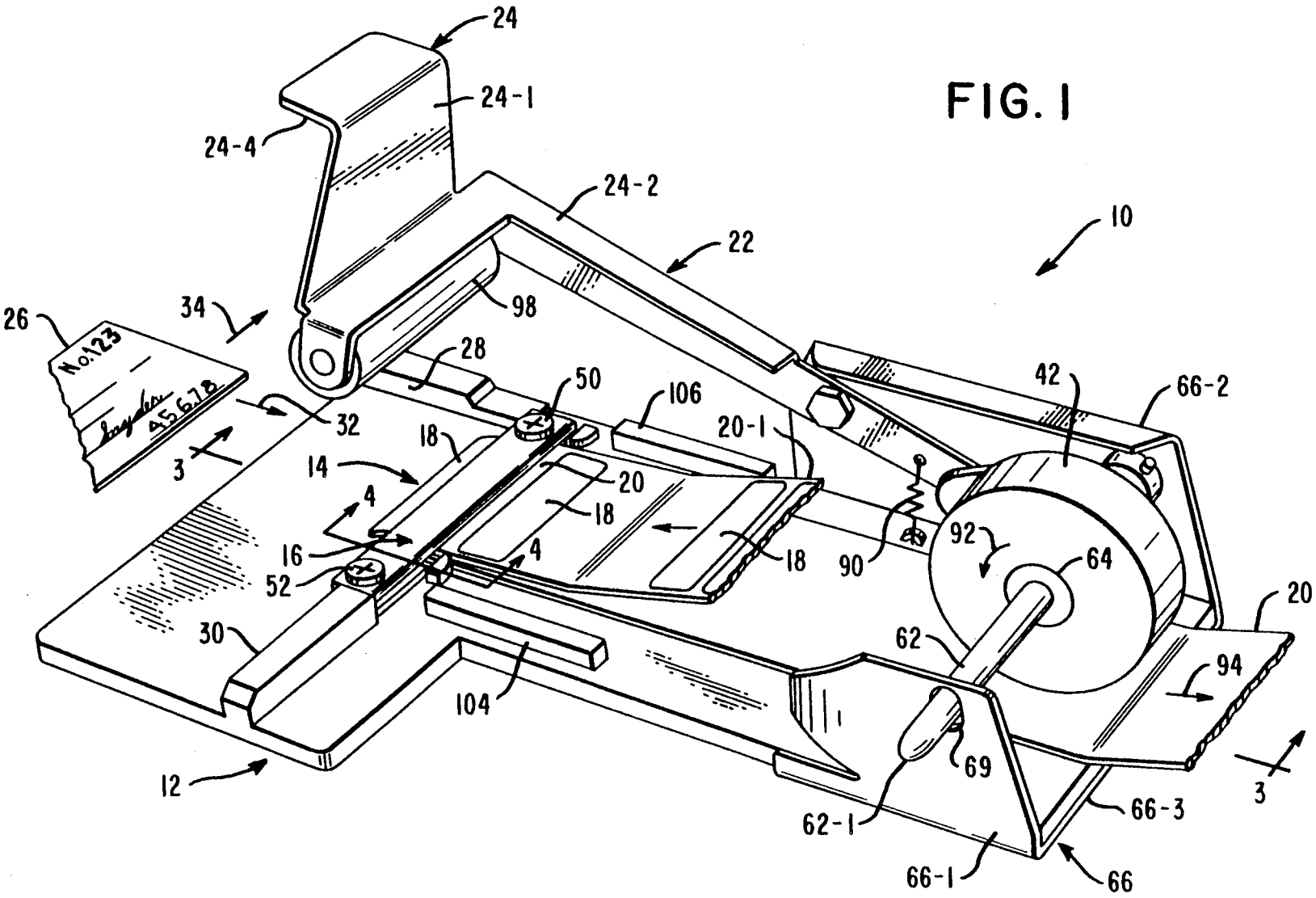
FIG. 1 is a general, perspective view of the apparatus of this invention, showing a plurality of correction stickers on a carrier being fed to an application station in the apparatus.

FIG. 1 is a general, perspective view of the apparatus of this invention which is designated, generally, as 10. As stated earlier herein, the function of the apparatus 10 is to facilitate applying a correction sticker to a document so as to cover an incorrectly-entered monetary amount on the document, permitting the correct monetary amount to be printed upon the correction sticker in a subsequent printing operation. Before discussing the apparatus 10 in detail, it appears useful to discuss the principal components of the apparatus 10.

The apparatus 10 includes a base or frame 12 which has the general "L"-shaped configuration shown in FIG. 1, an application station 14, separating means 16 for separating a correction sticker 18 from its associated carrier 20, and moving means 22 (including the operating handle 24) for moving the carrier 20 with the correction stickers 18 thereon to the application station 14. Each correction sticker 18 has pressure sensitive adhesive on the side which is in contact with the carrier 20, with the carrier 20 having a "non-stick" surface to enable the correction sticker 18 to be separated therefrom at the application station 14. The operating handle 24 is also used to move the correction sticker 18 into contact with the associated document, like check 26, for example, as will be described hereinafter.

The apparatus 10 (FIG. 1) also includes a locating means for locating the check 26 in operative relationship with the application station 14. In this regard, the locating means includes the lateral wall 28 which is upstanding from the frame 12 and also includes the wall 30 which is also upstanding from the frame 12 and is perpendicular to the lateral wall 28. Notice from FIG. 1 that as the check 26 is moved manually in the direction of arrows 32 and 34, the check 26 will abut against the walls 28 and 30 and thereby become positioned in operative relationship with the correction sticker 18 at the application station 14. When so positioned, the incorrect monetary amount which is shown on the check 26 as 456.78 will be properly positioned to receive a correction sticker 18 as will be described hereinafter. This monetary amount mentioned appears as incorrect MICR data under the signature line of the check 26 in the embodiment described. To orient the reader, the monetary amount mentioned appears on the lower right corner of the check 26 as one normally looks at it and as it is viewed in FIG. 1.

As alluded to earlier herein, the apparatus 10 also includes the separating means 16 shown in FIGS. 1, 3, 4, and 5, for example. The function of the separating means 16 is to separate a correction sticker 18 from the carrier 20 and to position the leading edge of the correction sticker 18 in an application position (as shown in FIG. 2) with regard to the check 26 located at the application station 14.

Figure 4:
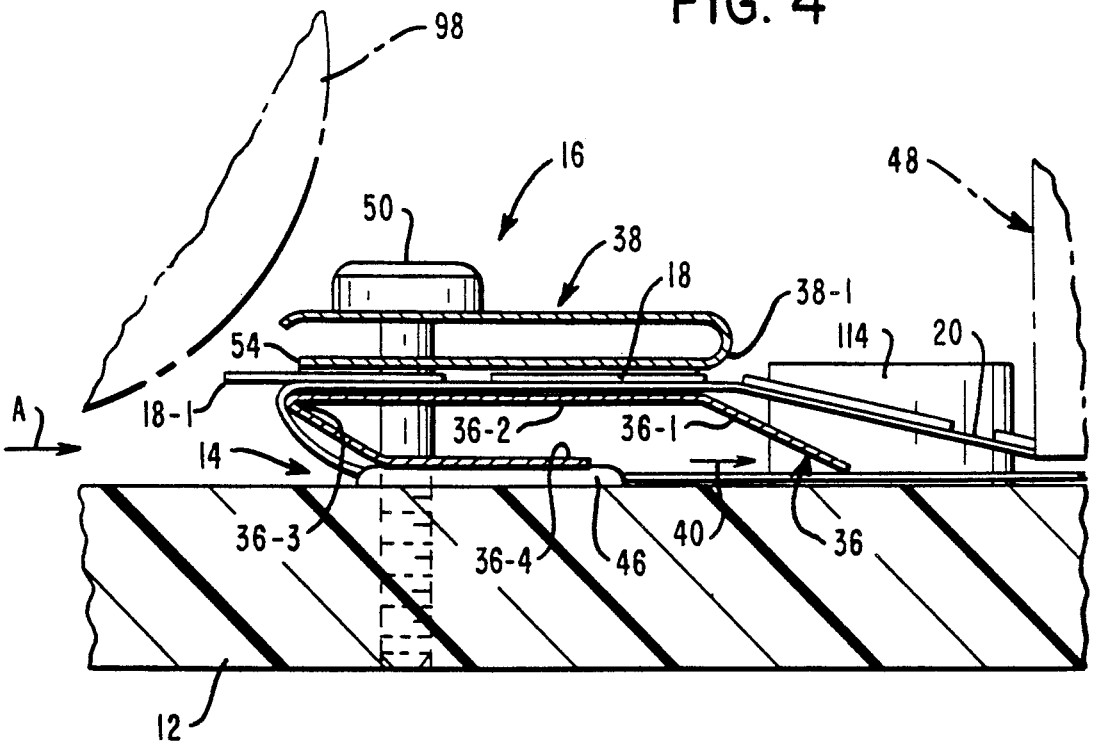
FIG. 4 is a general, cross-sectional view of a separating means for separating a correction sticker from the associated carrier and is taken along the line 4—4 of FIG. 1.

The separating means 16 includes an ejector plate 36 and a pressure plate 38 having the cross-sectional shapes shown best in FIG. 4. The ejector plate 36 has a ramp portion 36-1 to direct the carrier 20 to the horizontal portion 36-2. From the horizontal portion 36-2, the carrier 20 passes around the reverse bend portion 36-3, and it passes between the flat portion 36-4 and the frame 12. The carrier 20 is pulled in the direction of arrow 40 by the drive wheel 42 (FIG. 1), as will be described hereinafter. Notice from FIG. 5 that there are shims 44 and 46, located at opposed sides of the ejector plate 36, to permit the carrier 20 to pass between the flat portion 36-4 and the frame 12.

Figure 2:
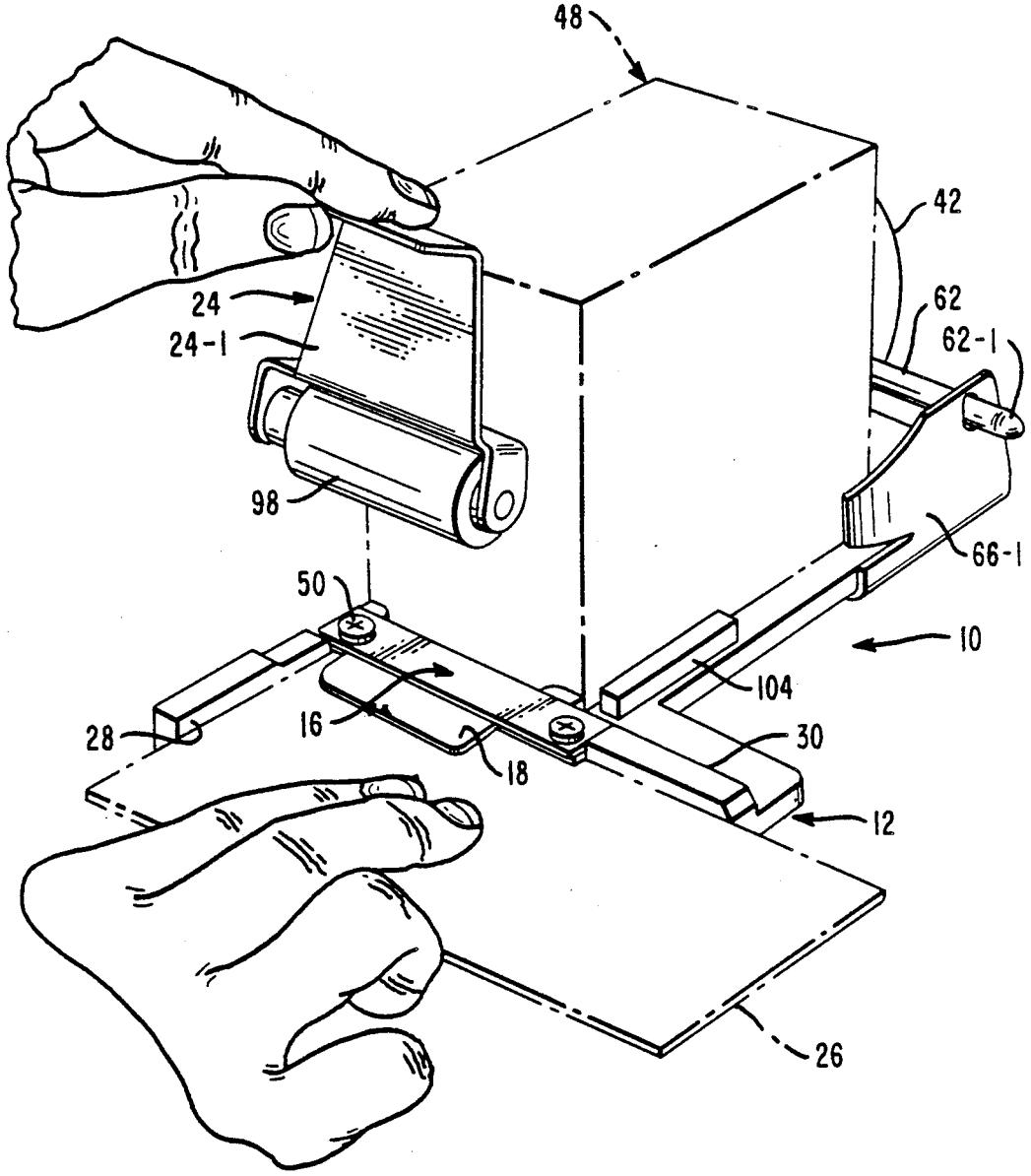
FIG. 2 is a general, perspective view of the apparatus shown in FIG. 1, with a check in position to receive a correction sticker, and with the operating lever of the apparatus being moved to a first position to move a correction sticker on the carrier into an application position with regard to the check at the application station; the apparatus is also shown with a box of correction stickers being located in the apparatus.

One function of the pressure plate 38 (FIGS. 3–5) is to provide a slight even drag on the carrier 20 with the correction stickers 18 thereon as they come out of a dispensing box 48, shown in FIG. 2, for example. Another function of the pressure plate 38 is to hold the carrier 20 at the proper position (essentially horizontal) at the point of separation at the reverse bend portion 36-3) between a correction sticker 18 and the carrier 20. If this proper positioning is not effected, the correction sticker 18-1, which is about to be dispensed, will roll prematurely towards the associated check 26 and will not be moved out far enough to the left (as viewed in FIG. 4) to be in a properly aligned position with regard to the associated check 26 at the application station 14.

Figure 5:
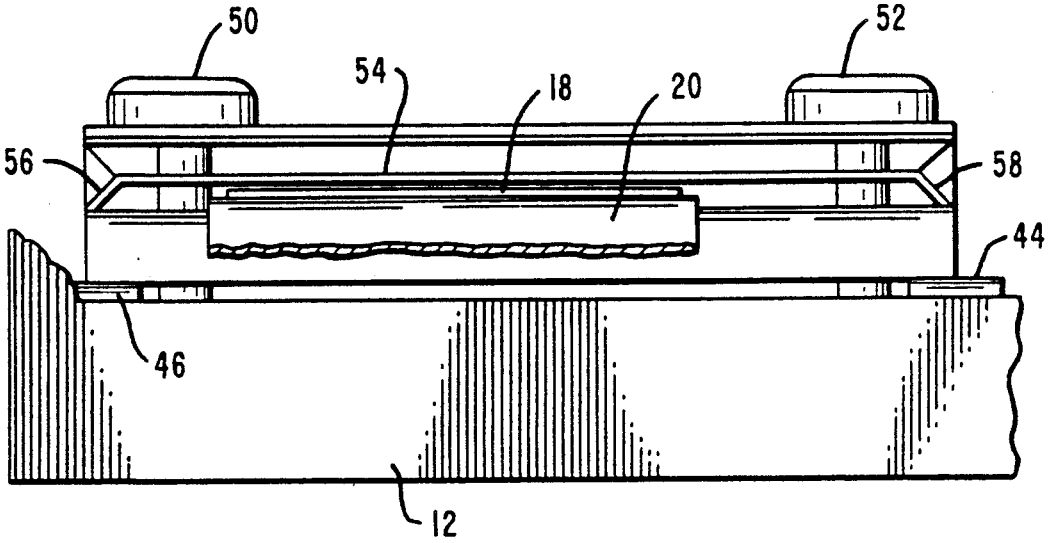
FIG. 5 is a front, elevational view of the separating means shown in FIG. 4 and is taken from the direction A shown in FIG. 4.

The ejector plate 36 and the pressure plate 38 are secured to the frame 12 by the fasteners 50 and 52 as shown best in FIG. 5. The fasteners 50 and 52 pass through suitable openings in the pressure plate 38 and the ejector plate 36. Notice that the lower edge 54 of the pressure plate 38 has downturned portions 56 and 58 which provide clearance for the carrier 20 with the correction stickers 18 thereon but still permit the pressure plate 38 to maintain the slight pressure on the carrier 20 and the correction stickers 18 as previously discussed. The pressure plate 38 is made of sheet metal which is bent into the "U"-shaped configuration shown in FIG. 4, with the joining portion 38-1 facilitating the flow of the carrier 20 with the correction stickers 18 thereon between the pressure plate 38 and the ejector plate 36. The side 20-1 (FIG. 1) of the carrier 20 which is closest to the upstanding wall 28 is aligned against the fastener 50 to provide for registration of a correction sticker 18 with regard to the length of the check 26. The side of the fastener 50 which contacts the side 20-1 of the carrier 20 is cylindrical and smooth so as to facilitate movement of the carrier 20. The other fastener 52 is positioned sufficiently far to the right, as viewed in FIG. 5, to enable the apparatus 10 to accept a carrier with correction stickers which are longer than the average length of correction sticker used. In the embodiment described, the length of the correction sticker 18 used is one and three quarter inches long. The longer than average correction sticker previously mentioned is two inches long; this longer correction sticker is used to cover the monetary amount mentioned plus certain transaction or TRAN codes appearing on a check 26. Naturally, different lengths of correction stickers may be used to suit particular applications.

The moving means 22, alluded to earlier herein, is used to position a correction sticker 18 in an application position at the application station 14 relative to the field to be covered on a document or check positioned at the application station 14.

One of the features of this invention is that the apparatus 10 is designed to accept the dispensing box 48 (FIG. 2) in which the correction stickers 18 are supplied. As an illustration, there are 1,000 correction stickers 18 on the carrier 20, with the carrier 20 being wound up into a roll within the dispensing box 48. In effect, the moving means 22 is used to pull the carrier out of the dispensing box 48 and position a correction sticker 18 at the application station 14 as previously described.

The moving means 22 includes the generally, "L" shaped operating handle 24 and the feed wheel 42 as principal elements for moving the correction stickers 18 to the application station 14. In this regard, the carrier 20 is loaded into the apparatus 10 by pulling a sufficient length of carrier 20 out of the dispensing box 48 and inserting it between the pressure plate 38 and the ejector plate 36 as shown in FIG. 4. Thereafter, the carrier 20 is pulled between the flat portion 36-4 of the ejector plate 36 and the frame 12. The carrier 20 is then pulled towards the feed wheel 42 and slipped under this feed wheel as will be described hereinafter. In the embodiment described, the feed wheel 42 is made of soft plastic material, like Neoprene, which has a hardness of 60 to 70 Durometer; Neoprene is a trademark of E. I. Du Pont de Nemours and Co.

Figure 3:
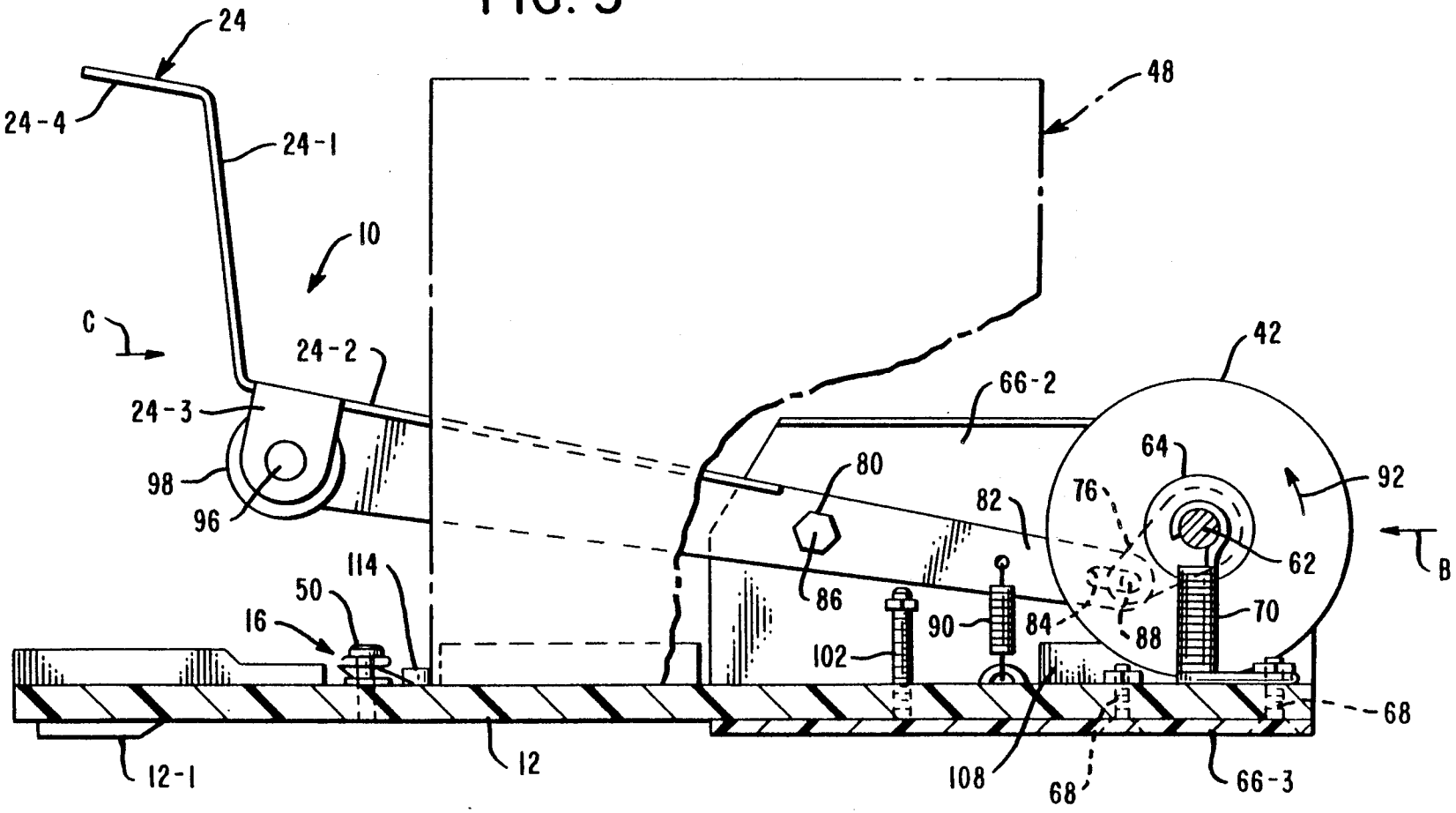
FIG. 3 is a general, cross-sectional view of the apparatus shown in FIG. 1 and is taken along the general line 3—3 of FIG. 1.
Figure 6:
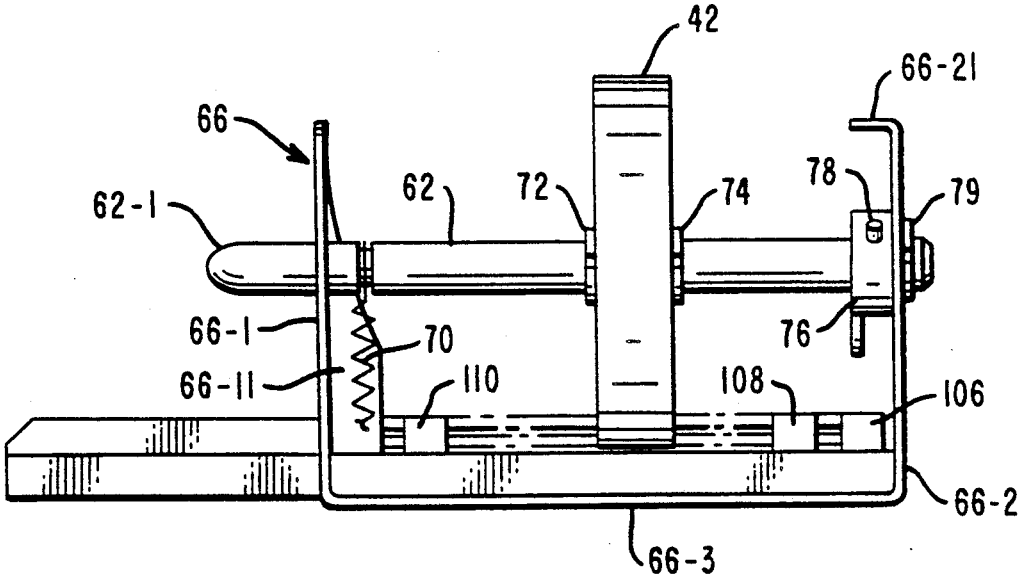
FIG. 6 is a rear, elevational view, taken from the direction of arrow B in FIG. 3, to show additional details of a feed wheel for moving the carrier with the correction stickers thereon.

The feed wheel 42 is mounted on the shaft 62 via a conventional one-way clutch 64 which is shown only schematically in FIG. 1. The shaft 62 is supported in a generally U-shaped support member 66 which has the side portions 66-1 and 66-2 and the bottom portion 66-3. The bottom portion 66-3 is positioned under the frame 12 and is secured thereto by fasteners 68 (FIG. 3). The right side of the shaft 62 (as viewed in FIG. 6) is rotatably mounted in the side portion 66-2 of the support member 66, and the left side of the shaft 62 is mounted in an elongated, vertically-aligned slot 69 in the side portion 66-1 as shown in FIG. 1. A spring 70 (FIG. 3) is used to resiliently bias the shaft 62 (and the feed wheel 42 thereon) towards the frame 12. By this construction, the end 62-1 of the shaft 62 which extends beyond the side portion 66-1 may be lifted or moved away from the frame 12 so as to lift the feed wheel 42 and permit the carrier 20 to be moved under the feed wheel 42 during the threading operation discussed earlier herein. As shown in FIG. 6, there are suitable "C" clips 72 and 74 fitted into complementary recesses (not shown) located on opposed sides of the feed wheel 42 to maintain the feed wheel 42 in the center of the carrier 20. A crank lever 76 is secured to the shaft 62 by a fastener 78 (FIG. 6) to rotate the shaft 62 when the crank lever 76 is rotated. The crank lever 76 and a "C" clip 79 which are positioned on opposite sides of the side portion 66-2 of the support member 66 are used to prevent axial movement of the shaft 62 within the support member 66.

The crank lever 76 is part of the positioning or moving means 22 for moving the carrier 20 so as to position a correction sticker 18 at the application station 14. In this regard, the crank lever 76 is coupled to the operating handle 24 as follows. The operating handle 24 is generally "L" shaped in configuration, and it has a first portion 24-1 and a second portion 24-2 as shown in FIG. 3, for example. The second portion 24-2 is pivotally mounted between its ends on a fastener or pin 80 which is secured to the side portion 66-2 of the support member 66. This mounting permits the second portion 24-2 to pivot in a plane which is perpendicular to the frame 12. Also, one end 82 of the second portion 24-2 has an elongated slot 84 therein, with the slot 84 being radially aligned with reference to the center 86 of pin 80. The crank lever 76 has a pin 88 extending therefrom as shown in FIG. 3, with the pin 88 extending through and coacting with the elongated slot 84 in the portion 24-2 of the operating handle 24. A tension type spring 90 is used to bias the operating handle 24 towards a first position shown in FIG. 1, for example.

The operation of the operating handle 24 is as follows. When the operating handle 24 is moved from a position in which the application roller 98 on the operating handle 24 contacts a check 26 at the application station 14 towards the position shown in FIG. 1, the portion 24-2 of the operating handle 24 will pivot about pin 80, causing the crank lever 76 to rotate the feed wheel 42 in the direction of arrow 92 in FIG. 3. When so rotated, the feed wheel 42 will move the carrier 20 in the direction of arrow 94 in FIG. 1, thereby moving a correction sticker 18 on the carrier 20 towards the application station 14 as previously described. The surface of the frame 12 is smooth to enable the carrier 20 to be moved freely when pressed against the surface of the frame 12 by the feeding or rotating of the feed wheel 42. The one-way clutch 64, alluded to earlier herein, permits the feed wheel 42 to rotate only in the direction of arrow 92 (FIG. 3).

One of the features of the present invention is that the operating handle 24 can be moved incrementally towards the first position mentioned so as to incrementally feed the carrier 20 towards the application station 14. The significance of this feature is that it enables a first correction sticker 18 to be accurately aligned with reference to the application station 14 when setting up the apparatus 10, for example. Once the first correction sticker 18 is positioned as previously described, the operating handle 24 is moved towards the second position or towards the frame 12 to press the correction sticker 18 against the check 26 as will be described hereinafter. Thereafter, the operating handle 24 may be released, enabling the spring 90 (FIG. 3) to raise or move the operating handle 24 to the first position shown in FIG. 1. When the operating handle reaches the first position, the next correction sticker 18 on the carrier will be properly positioned with reference to the application station 14. Notice also that as the operating handle 24 is moved towards the frame 12 or towards the second position, the one-way clutch 64 is effective to prevent rotation of the feed wheel 42.

Figure 7:
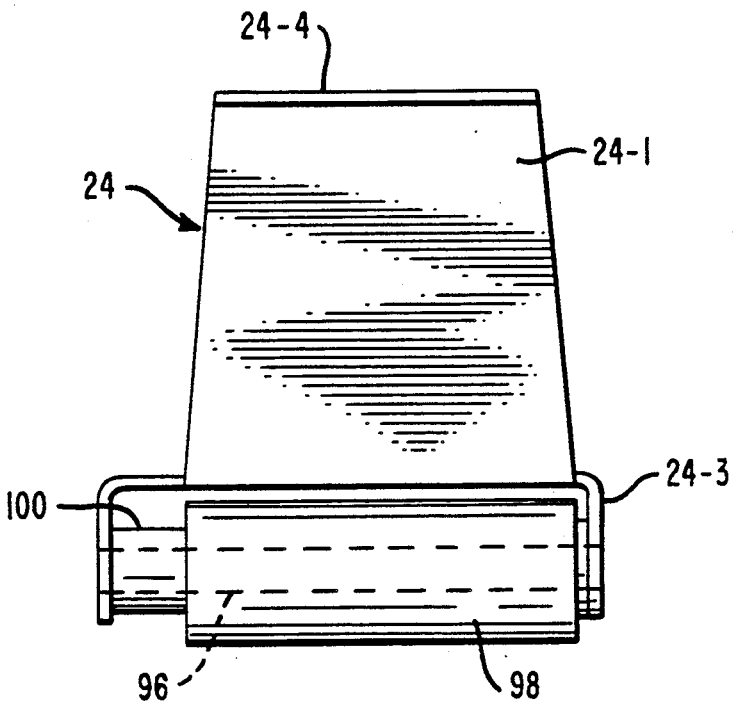
FIG. 7 is an end view, in elevation, which is taken from the direction of arrow C in FIG. 3 to show additional details of the operating handle and an associated application roller.

The operating handle 24 is used, also, in actually pressing a correction sticker 18 on the field to be covered on the associated document or check 26. In this regard, the operating handle 24 has a "U" shaped portion 24-3 (FIG. 7) which supports a rod 96 which is rotatably mounted therein. The application roller 98 is forced on the rod 96, and a bushing 100, which is also forced on the rod 96, is used to position the application roller 98 relative to the correction sticker 18 to be applied. The application roller 98 is made of the same material and is of the same hardness as is the feed wheel 42. The operating handle 24 also has a flange portion 24-4 to facilitate moving it between the first and second positions mentioned. With the construction described, a low cost apparatus 10 is produced.

While the principles of this invention may be extended to a variety of sizes, it is useful to illustrate the dimensions of the particular embodiment disclosed herein. For example, FIG. 3 shows the apparatus 10 substantially in full scale. The distance between the axis of shaft 62 and the axis of rod 96 is six inches, the diameter of the feed wheel 42 is two inches, and the diameter of the application roller 98 is $\frac{3}{4}$ inch. The particular carrier 20 and correction stickers 18 used in the apparatus 10 have a pitch of one-half inch. This means that it is one-half inch from the leading edge of one correction sticker 18 on the carrier 20 to the leading edge of the next adjacent correction sticker 18 on the carrier 20. Using correction stickers 18 with this particular pitch means that a full stroke of the operating handle 24 in being moved from the second position in which the application roller 98 contacts a check 26 at the application station 14 to the first position shown in FIG. 1 is effective to rotate the feed wheel 42 through an arc which moves the carrier 20 the pitch distance of one-half inch in the embodiment described. An adjustable stop 102 (FIG. 3) is used to limit the movement of the operating handle 24 at the first position.

In using the apparatus 10 with the dimensional relationships mentioned, the application roller 98 contacts the leading edge of a correction sticker 18 as the application roller 98 is moved by an operator towards the application station 14 as approximated in FIG. 4. After the leading edge of the correction sticker 18 is applied to the check 26, the operator continues to apply pressure on the operating handle 24 with one hand, while the operator pulls the check towards the operator or away from the wall 30. By this action, the application roller 98 firmly presses the correction sticker 18 over the field of incorrect data on the check 26 to be adhesively secured thereto. The check 26 with the correction sticker 18 thereon can then be processed to have the correct monetary amount printed on the clear correction sticker 18.

Figure 8:
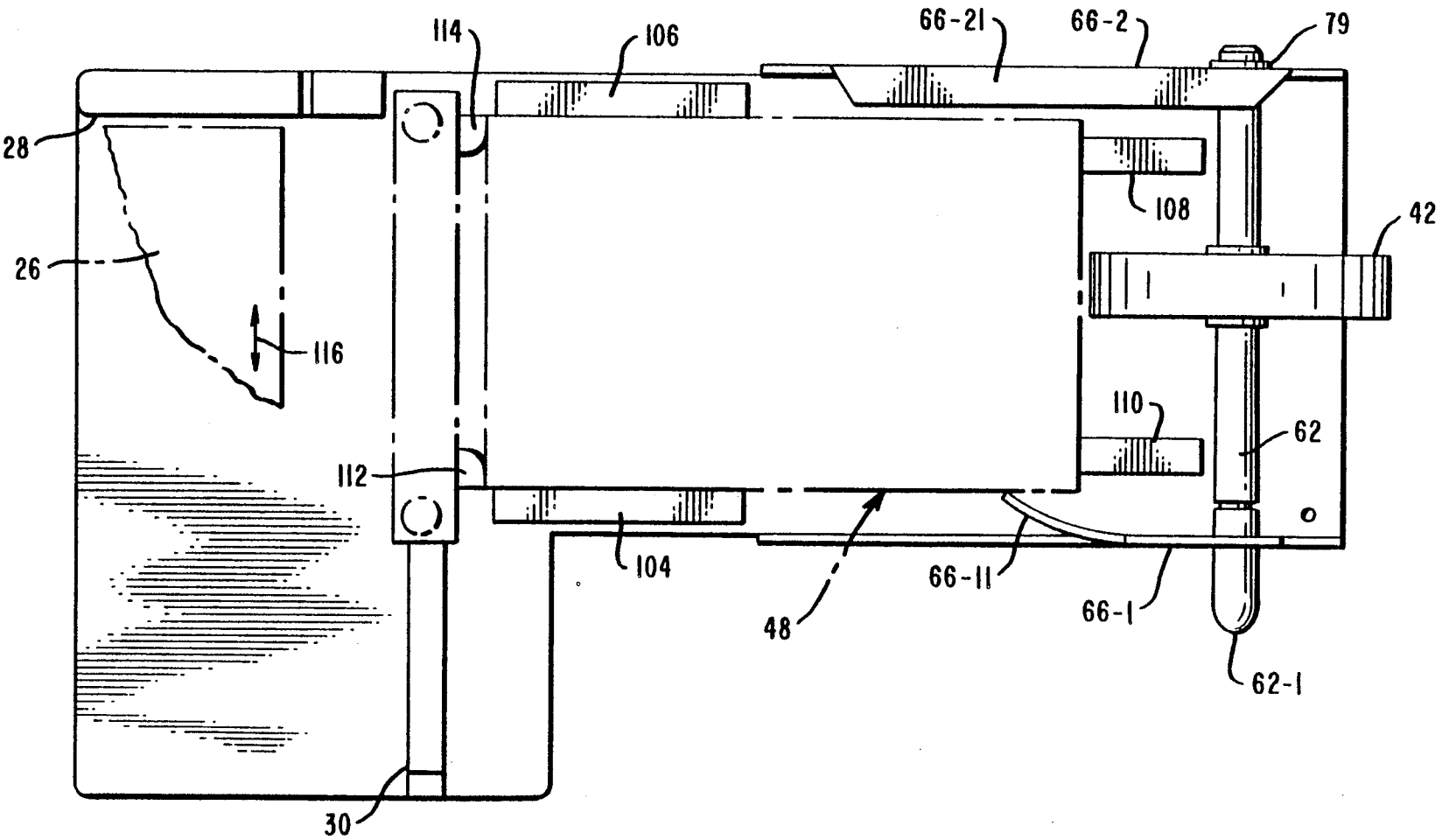
FIG. 8 is a plan view of the apparatus shown in FIG. 1 with certain elements removed to show how a conventional dispensing box is mounted in the apparatus.

Another feature of this invention is that the apparatus 10 is designed to receive a commercially available dispensing box 48 in which the correction stickers 18 are loaded. In this regard, FIG. 8 shows bars 104, 106, 108, and 110 which are about $\frac{1}{4}$ inch in height and are upstanding from the frame 12 and positioned so as to receive the dispensing box 48 shown in dashed outline in FIG. 8. The side portion 66-1 of the support member 66 has a turned-in portion 66-11 which also contacts the dispensing box 48 to hold it in place; the same is true for the flange 66-21 shown best in FIG. 6. FIG. 8 also shows two small guides 112 and 114 which are used to align the carrier 20 relative to the application station 14 so that the correction sticker 18 can be applied accurately along the length of the check 26, with the length being shown by double arrow 116. The second portion 24-2 of the operating handle 24 is located close to the side portion 66-2 so as to not interfere with the placement of the dispensing box 48 on the frame 12. The lower side of the frame 12 has rubber feet, like 12-1, depending therefrom as shown in FIG. 3 to enable the apparatus to remain stationary while in use.

What is claimed is:

1. An apparatus for applying a correction sticker to cover a field on a document comprising:

a frame;

an application station located on said frame;

locating means for locating a document so that a field to be covered on the document is positioned in operative relationship with said application station;

supply means for supplying a plurality of correction stickers to said application station;

said supply means including a carrier having a said plurality of correction stickers detachably secured thereto in spaced relationship on said carrier; said plurality of correction stickers having pressure sensitive adhesive thereon;

separating means located at said application station for separating a correction sticker from said carrier as said carrier is moved relative to said application station;

moving means for moving said carrier so as to position a leading edge of a correction sticker in an application position relative to said field to be covered;

said moving means including a lever which is pivotally mounted in said frame for movement between first and second positions in said frame;

said lever when moved away from said application station incrementally towards said first position being effective to incrementally feed a correction sticker towards said application position;

said lever having a roller directly thereon to press said leading edge of a correction sticker into adherence with the associated document at the application station as said lever is moved to said second position and to also press the remaining portion of said correction sticker over the field on said document as said lever is retained in the second position and the document is pulled out of the application station;

said separating means including an ejector plate and a pressure plate which are positioned at said application station; and said moving means including a feed wheel to engage said carrier and also including coupling means for coupling said feed wheel to said operating lever to enable said feed wheel to move said carrier towards said application station;

said carrier with said plurality of correction stickers thereon being threaded between said ejector plate and said pressure plate so as to enable the leading edge of a correction sticker to be moved towards said application position as said feed wheel moves said carrier, said ejector plate having a reverse bend therein to enable the correction sticker whose leading edge is being moved towards application position to be partially separated from said carrier, and said pressure plate being effective to maintain the correction sticker in a substantially parallel position relative to a document positioned in operative relationship with said application station until the leading edge of the correction sticker is moved into adherence with said document at said application station by said roller; and said coupling means also including a one way clutch coupled between said operating lever and said feed wheel to enable said feed wheel to move said carrier only when said operating lever is moved from said second position towards said first position and to hold said carrier stationary as said operating lever is moved from said first position to said second position.

2. The apparatus as claimed in claim 1 in which said frame has holding means thereon for holding a dispensing box thereon; and said apparatus also includes a said dispensing box mounted in said holding means with said carrier having said plurality of correction stickers thereon being dispensed from said dispensing box.

3. The apparatus as claimed in claim 2 in which said dispensing box is located between said separating means and said feed wheel.

4. The apparatus as claimed in claim 2 in which said moving means has means for adjusting the limit of said lever in moving from said second position to said first position.

* * * * *